US005085387A

United States Patent [19]

Peterson et al.

[11] Patent Number: 5,085,387

[45] Date of Patent: Feb. 4, 1992

[54] WATER HEATER SUPPORT SYSTEM

[75] Inventors: Brent Peterson, Springville; Verl Hovey, Orem, both of Utah

[73] Assignee: Quake Safe Corporation, Provo, Utah

[21] Appl. No.: 666,831

[22] Filed: Mar. 8, 1991

[51] Int. Cl.[5] ..... A47G 23/02

[52] U.S. Cl. ..... 248/154; 248/126; 248/500; 248/676; 248/680

[58] Field of Search ..... 248/154, 500, 510, 674, 248/676, 680, 152, 176, 230, 231.91, 678, 679, 126, 121; 52/146, 151, 152

[56] References Cited

U.S. PATENT DOCUMENTS

| | | | |
|---|---|---|---|
| 2,472,752 | 6/1949 | Mackereth | 248/674 |
| 3,201,075 | 8/1965 | Sievers | 248/154 X |
| 4,137,576 | 2/1979 | Greene | 52/146 X |
| 4,489,846 | 12/1984 | Nickel | 248/128 X |
| 4,643,386 | 2/1987 | Chastine | 248/678 X |
| 4,955,573 | 9/1990 | Horvath | 248/154 X |

*Primary Examiner*—Ramon O. Ramirez
*Attorney, Agent, or Firm*—Lynn G. Foster

[57] ABSTRACT

A water heater support system, and related methods, which protects the water heater from sustaining earthquake damage, which in turn might furhter cause damage to the building in which it is located and/or nearby people.

10 Claims, 2 Drawing Sheets

WATER HEATER SUPPORT SYSTEM

FIELD OF INVENTION

The present invention relates generally to earthquake protection and specifically to a water heater support system, and related methods, which protects against rupture or toppling over of the water heater during an earthquake.

BACKGROUND

One form of damage known to be caused by an earthquake relates to water heaters, both electric and gas-fired. The shaking which accompanies the earthquake can set up a vibration which ruptures the water heater or causes it to fall from its erect position. When this happens, water leakage occurs which can flood and water damage the premise. Electric fires and short circuits also can occur when the water heater falls. With gas-fired water heaters, toppling thereof due to earthquake activity can cause gas line rupture, which risks explosion and devastating fire.

BRIEF SUMMARY AND OBJECTS OF THE INVENTION

In brief summary, the present invention is intended to overcome or materially alleviate the aforementioned problems and comprises a water heater support system, and related methods, which protects the water heater from sustaining earthquake damage and in turn further causing damage to the building in which it is located and nearby people.

With the foregoing in mind, it is a primary object of this invention to overcome or materially alleviate the problems mentioned above.

It is another important object to provide a novel water heater support system, and related methods.

A further significant object is the provision of novel support structure, and related methods, for protecting gas and electric water heaters against receiving or causing damage due to earthquake activity.

These and other objects and features of the present invention will be apparent from the detailed description taken with reference to the accompanying drawings.

DETAILED DESCRIPTION OF THE ILLUSTRATED EMBODIMENTS

Figure 1:
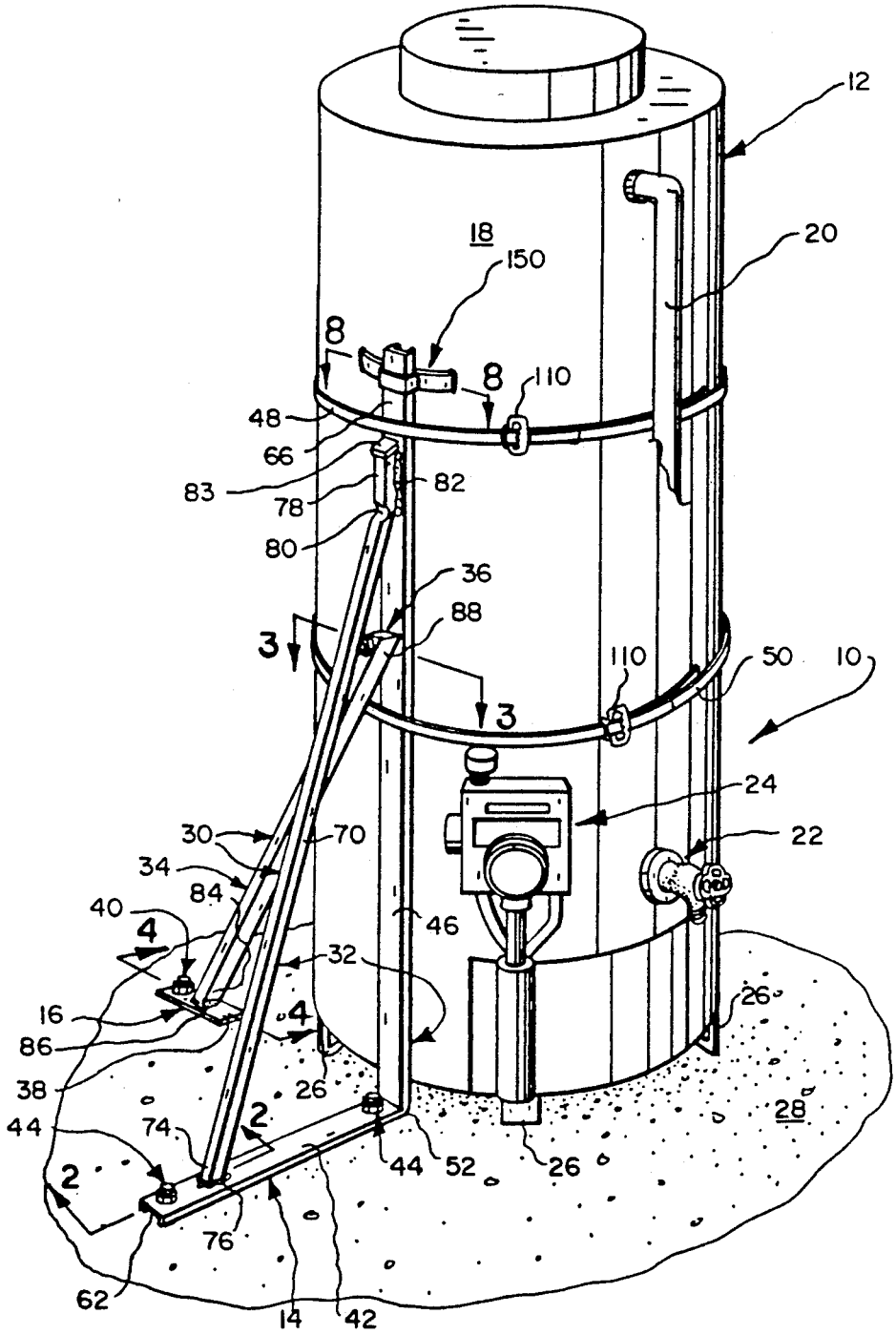
FIG. 1 is a perspective representation of a presently preferred configuration of the invention, shown in its installed state.

Reference is now made to the drawings wherein like numerals are used to designate like parts throughout. Specifically, FIG. 1 illustrates in perspective a presently preferred water heater support system, generally designated 10, in its installed condition so as to be interposed between a water heater, generally designated 12, and two floor sites, generally designated 14 and 16, respectively. The water heater 12 is illustrated as being a conventional gas-fired water heater, although the present invention applies to any commercially available water heater, including electrically-driven and gas-fired water heaters. Water heater 12 is illustrated as comprising a cylindrical exterior 18, a relief valve overflow drain 20, a manually-operable tank drain spout 22 and gas controls, generally designated 24. Any insulation around the water heater is removed and replaced after installation of the water heater support system 10.

The water heater 12 is illustrated as being supported by legs 26 upon a concrete surface 28. Typically, the top surface 28 of a concrete floor 29 (FIG. 2) is disposed in a horizontal plane. Thus, the water heater 12, in its illustrated operative position, extends in an erect vertical posture.

FIG. 1 further illustrates a presently preferred water heater support bracket, generally designated 30. Support bracket 30 comprises a main support frame, generally designated 32, and a secondary or side support brace, generally designated 34. Main support frame 32 and secondary or side support brace 34 are joined one to the other at connection site 36. The lower end of the side support brace 34 is secured via bearing or foot plate 38 to the concrete floor by a fastener assembly 40. Similarly, the main support frame is illustrated as being anchored to the concrete floor at horizontally-directed segment or member or foot bar 42 by two fastener assemblies 44.

The main support frame 32 is connected to the water heater 12 via a vertical component or member 46 by use of two tight steel bands, top band 48 and lower or bottom band 50.

More specifically, main support frame 32 comprises two structural members, i.e., an L-shaped member comprising horizontal portion 42 and vertical portion 46 conventionally bended at corner 52 through essentially 90°. Bend 52 can be manually adjusted as needed during installation. The L-shaped member 42/46 is illustrated as being a standard structural steel channel-shaped member. It has been found that a standard structural steel channel member having a width of one and one-half inches and a depth of one-half of one inch is satisfactory for use as member 42/46 to provide stability in conjunction with residential water heaters where the vertical leg 42 is on the order of thirteen inches in length and the vertical component 46 is approximately four feet in length.

Figure 2:
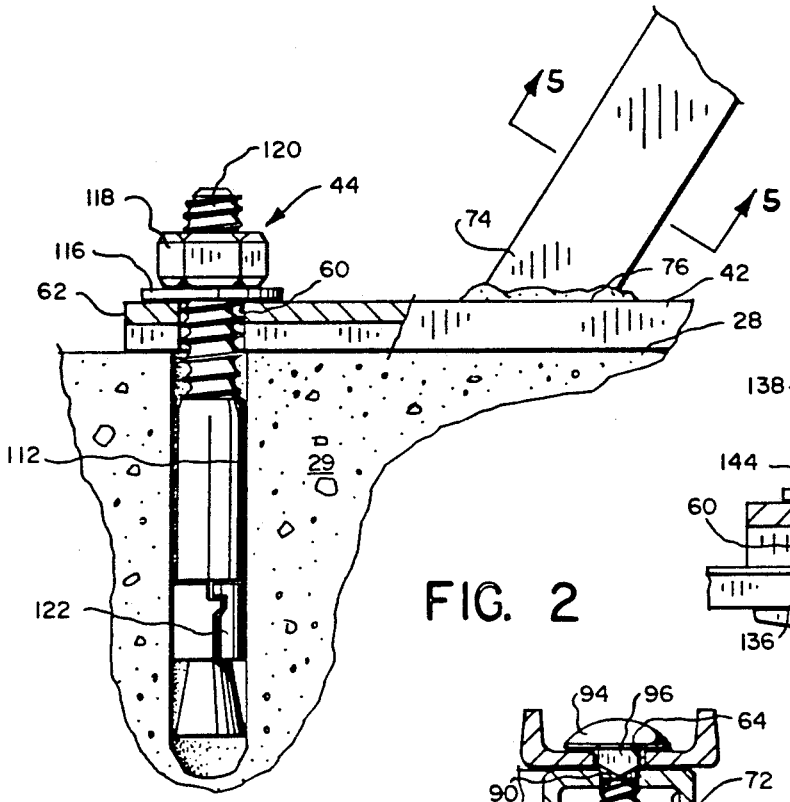
FIG. 2 is an enlarged cross section taken along lines 2—2 of FIG. 1.

The web of the horizontal member 42 is predrilled at fastener locations 44 to form apertures 60, one of which is illustrated in FIG. 2. As presently preferred, each aperture 60 in the web portion of the channel member 42 may be about one-half inch in diameter, for purposes to be explained in detail hereinafter. One aperture 60 is located directly adjacent to the blunt edge 62 of the channel-shaped leg 42, while the other aperture 60 is at the fastening site 44 directly adjacent the corner 52. The vertically-directed leg 46 has a square aperture 64 (FIG.

3) disposed in the web thereof about two-thirds the distance up the leg 46. The leg 46 terminates in a free upper end 66.

Figure 5:
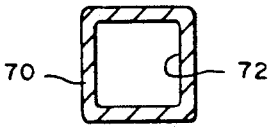
FIG. 5 is a cross section taken along lines 5—5 of FIG. 2.

The main support frame also comprises a diagonal member 70, which is illustrated as comprising a standard structural steel member comprising a square cross section having a hollow square interior 72, as illustrated in FIG. 5. The outside dimensions of member 70 may be 1"×1" for residential installations. Diagonal member 70 is disposed at acute angles to both the horizontal and the vertical. The lower end 74 is cut at an angle so as to be flush or contiguous with the top surface of the horizontal leg 42 and is there rigidly secured by weldment 76. The upper end 78 is vertically-directed, having been bent conventionally through an angle at site 80 so as to be contiguous with the adjacent surface of the web of the vertically-directed leg 46. End 78 is secured to the leg 46 in rigid relation by weldment 82. The hollow at the top edge of end 78 is illustrated in FIG. 1 as being covered by a press-fit plastic cap 83. Thus, main support frame 32 is generally a triangularly-shaped rigid frame.

In the installed condition, the bottom surfaces of the two flanges of the channel-shaped vertical member 46 contiguously engage the exterior surface 18 of the water heater 12, being secured in said position against relative movement as illustrated by steel bands 48 and 50, as explained herein in greater detail.

The side support brace 34 is illustrated as being comprised of the same structural steel shape as used to form diagonal member 70. Side support brace 34 is in fact a second diagonal support member and is disposed in a plane substantially normal to a plane containing legs 42 and 46 and diagonal member 70. The lower end 84 is angularly cut so as to contiguously engage the top surface of the bearing plate 38 and is secured to the bearing plate 38 by weldment 86.

Figure 3:
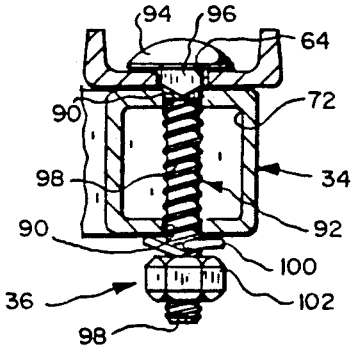
FIG. 3 is an enlarged cross section taken along lines 3—3 of FIG. 1.

The upper end 88 of the diagonal member 34 is angularly cut and apertured at two aligned sites 90 (FIG. 3) in such a way that the apertures 90 are placed in alignment with the aperture 64 in the vertical member 46 whereby fastener assembly 92 is put together through the aligned apertures so as to reliably join the top end of the diagonal member 34 to the main support frame. Fastener assembly 92 is conventional, comprising a bolt comprising a rounded head 94, a square portion 96 which nonrotatably is received in aperture 64, threads 98, a lock washer 100 and a nut 102. It should be clear that the fastener assembly 92 is positioned as illustrated in FIG. 3 prior to installation in conjunction with a water heater as illustrated in FIG. 1.

The water heater support frame work 30, described above, is installed by placing the horizontal leg 42 in flush condition along the surface 28 of the concrete floor 29. Similarly, with the side support brace 34 connected to the main support frame 32 at connection site 36 (explained above), the bearing plate 38 is similarly placed with its bottom surface flush with the surface 28 of the concrete floor 29.

In that condition, the top and bottom steel bands 48 and 50 are loosely positioned, essentially in the locations illustrated in FIG. 1, with the free end of each steel band being placed somewhat loosely through the associated buckle 110. While one steel band could be used, two are presently preferred.

Figure 4:
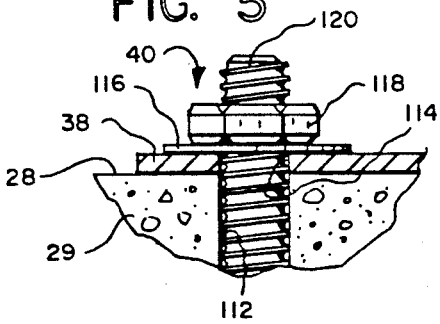
FIG. 4 is an enlarged cross section taken along lines 4—4 of FIG. 1.

Next, appreciating that the fastener assemblies 40 and 44 are not yet in position, an appropriately-sized drill bit, carried by a drill, is caused sequentially to pass through each of the two apertures 60 in the web of the horizontal leg 42 to create a blind bore 112 in alignment with each aperture 60. The depth of each blind bore is presently preferred to be three and one-half inches. Similarly, the drill bit is caused to pass through the aperture 114 in the bearing plate 38 creating a further blind bore 112 in the concrete floor 29 which is in alignment with aperture 114. See FIG. 4.

Concrete anchor bolt assemblies 40 and 44, absent the exposed lock washer 116 and nut 118 are placed through the apertures 60 and 114 so that one each is disposed in each concrete blind bore 112, with the threaded end 120 of each exposed. Next, a washer is dropped over each threaded shaft 120 and a nut 118 caused to threadedly engage the associated shaft 120. Each nut 118 is tightened, which causes an expansion sleeve 122 of each fastener assembly 40 and 44 to diametrally enlarge or expand until each sleeve 122 firmly engages the associated blind bore 112 to create a rigid connection. See FIG. 2.

Figure 8:
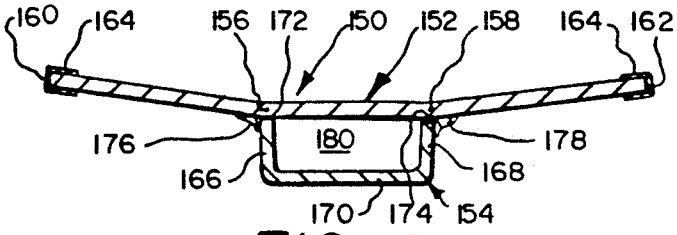
FIG. 8 is a cross section taken along lines 8—8 of FIG. 1.

While not strictly essential, utilization of the restrain yoke 150 has been found to be of substantial benefit in stabilizing the upper end 66 of the vertical member 46 against to and fro movement along the exterior surface of the water heater 12 during installation and thereafter. With specific reference to FIG. 8, yoke 150 is illustrated as primarily comprising two steel members 152 and 154, respectively. Steel piece 152 comprises a plate bent through a slight angle at sites 156 and 158. The bends at sites 156 and 158 are of such a nature so that the member 152 largely conforms to the exterior diameter of the water heater 12. Plate 152 comprises blunt ends 160 and 162, which are illustrated as being covered by a suitable high-friction resinous material 164, which tends to grip the exterior surface of the water heater 12 to prevent displacement. Steel member 154 is generally U-shaped in its cross-sectional configuration comprising spaced flanges 166 and 168, which are integrally connected by a web 170. Flanges 166 and 168 terminate in blunt edge surfaces 172 and 174, respectively. Edges 172 and 174 are placed contiguous with the plate 152 adjacent bend sites 156 and 158 and are secured thereto by weldments 176 and 178, respectively.

In its assembled condition, collectively steel plate 152 and steel U-shaped member 154 form a collar having an opening 180, sized and shaped to snugly fit around the cross section of the end 166 of the vertical member 46, to accommodate slidable insertion of the yoke 150 over the end 166 to stabilize as indicated. The thickness of the U-shaped member 154 may also be on the order of one-quarter of one inch.

Thereafter, each steel band 48 and 50 is fully tightened in a conventional fashion, such as with the assistance of pliers, with the free end of each band thereafter being bent through approximately 180° and associated conventionally with the buckle 110 which are closed to secure each steel band 48 and 50 into its fully installed, tight condition. Care is at all times taken to be sure that the steel bands 48 and 50 do not in any way interfere with the operation or access to any of the features of the water heater 12, such as the gas control mechanism 24. The placement of one band in engagement with the upper end 66 of member 46 is desirable.

If desired and particularly where the concrete floor 29 is subjected to a high water table, silicone resin adhesive preferably is placed in each blind bore 112 to create a water-tight seal prior to the installation of the concrete anchor bolt assemblies 40 and 44 as explained above.

Figure 6:
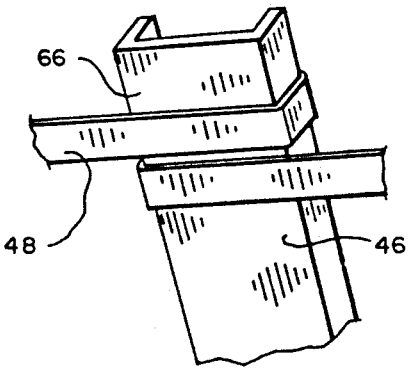
FIG. 6 is an enlarged fragmentary perspective of a second way of interrelating a steel band with a vertical leg of a main support bracket shown in FIG. 1.

It is to be appreciated that in lieu of simply placing the steel bands 48 and 50 around one surface at the web of the vertically-extending member 46, one or both bands 48 and 50 may be wrapped around the vertical member 46 through 360°, as illustrated in FIG. 6.

Figure 7:
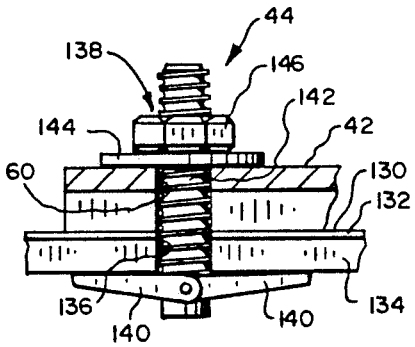
FIG. 7 is an enlarged cross section similar to FIG. 2, but of a toggle bolt connection for a wood as opposed to a concrete floor.

Furthermore, where the floor upon which the water heater 12 rests is a wooden floor, the arrangement shown in FIG. 7 may be utilized at each aperture site 60 and 114. Specifically, in regard to one fastener site 44, the horizontally-directed member 44 is flush along the bottom edge of each channel leg with the top surface 130 of a floor shown to comprise a top layer 132, such as linoleum, and a lower level 134 such as a wooden subfloor layer. When installing on wood floors, position brace in desired location, mark floor through holes in base, remove support, drill correct size holes (1¼") through floor. Insert bolts through holes in support base, install winged toggles on bolts, insert all three toggles through holes in floor. Thus, a winged toggle anchor bolt assembly 138, with expandable wings 140 at the distal end thereof is, with the expandable segments 140, folded or rotated to be directed parallel to the threaded shaft 142 of the toggle fastener assembly and the toggle bolt is inserted through the aligned apertures 60 and 136 a distance sufficient to allow the spring-loaded segments 140 to expand and to occupy a radially-extending position as shown in FIG. 7. Thereafter, the nut 146 above the lock washer 144 is tightened upon the threaded shaft 142.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by Letters Patent is:

1. In combination, a vertically erect water heater comprising an internal reservoir, means of the water heater which conceals and supports water therein and externally connected energy means by which the water in the water heater is heated and a water heater support frame adapted to resist external loads such as earthquake shocks from tipping over the water heater severing the energy means so as to create an energy danger for humans, the water heater support frame comprising:

at least one vertical member;

means connecting the vertical member to the water heater so that externally imposed motion forces such as earthquake shocks imposed upon the water heater are transferred to the vertical member so that the water heater does not tip over;

at least one horizontal member anchored to a floor site to which the externally imposed motion forces are transferred;

at least one diagonal member spanning angularly between and rigidly connected to the vertical and horizontal members.

2. A combination according to claim 1 further comprising a second diagonal member spanning angularly between and rigidly connected to a frame site and a second floor site.

3. A combination according to claim 1 wherein the horizontal member is anchored to the floor site by fastener means.

4. A combination according to claim 1 wherein the one diagonal member is connected by welding to the vertical and horizontal members.

5. A combination according to claim 1 wherein the vertical member, the horizontal member and the diagonal member comprise standard structural steel shapes.

6. In combination, a water heater and a water heater support frame, the water heater support frame comprising:

at least one vertical member;

means connecting the vertical member to the water heater so that motion forces imposed upon the water heater are transferred to the vertical member, the connecting means comprising steel band means;

at least one horizontal member anchored to a floor site;

at least one diagonal member spanning angularly between and rigidly connected to the vertical and horizontal members.

7. In combination, a water heater and a water heater support frame, the water heater support frame comprising:

at least one vertical member;

means connecting the vertical member to the water heater so that motion forces imposed upon the water heater are transferred to the vertical member;

at least one horizontal member anchored to a floor site;

at least one diagonal member spanning angularly between and rigidly connected to the vertical and horizontal members;

an anti-slip member at the top of the vertical member to restrain the vertical member against undesired movement.

8. Water heater support structure for stabilizing a water heater in an erect condition against tipping over and severance of gas or electrical supply lines due to loads, such as earthquake shocks, externally imposed upon the water heater comprising:

vertically-directed support means for contiguous engagement with and connection to a water heater to which said externally imposed water heater loads are imposed;

horizontally-directed base means connected to the vertically-directed support means and adapted for contiguous engagement with and connection to a floor site to which said externally imposed water heater loads are transferred;

diagonally-directed support means connected to at least one of the vertically-directed support means and the horizontally-directed base means.

9. An anti-earthquake water heater support bracket for stabilizing an erect operable water heater against tipping over and severance of an energy supply line due to loads, such as earthquake shocks, externally imposed upon the water heater comprising first means connected to and contiguous with the water heater by which the forces externally imposed on the water heater are transferred to the bracket, second means contiguous with and connected to a floor site by which the externally imposed water heater forces received by the bracket are transferred to the floor, and third means providing diagonal support to the bracket.

10. An anti-earthquake water heater support bracket comprising first structural member means connected to and contiguous with the water heater by which forces imposed upon the water heater are transferred to the bracket, second structural member means contiguous with and connected to a floor site adjacent to the water heater by which forces received by the bracket from the water heater are transferred to the floor, third structural member means connected to and spanning diagonally between the first and second structural member means, and fourth structural member means connected to the bracket and spanning away from the third structural means.

* * * * *